United States Patent [19]

Perne et al.

[11] Patent Number: 4,771,904

[45] Date of Patent: Sep. 20, 1988

[54] TAMPERPROOF CLOSING MEANS FOR A THREADED CONTAINER NECK

[76] Inventors: Raymond Perne, Le Maquisarde Morance, 69480 Anse, Rhône; Philippe Odet, route de Montlzulin, 69380 Chasselay, Rhône, both of France

[21] Appl. No.: 65,166

[22] Filed: Jun. 19, 1987

[30] Foreign Application Priority Data

Jun. 24, 1986 [FR] France ..... 86 09800

[51] Int. Cl.[4] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 4,147,268 | 4/1979 | Patel et al. | 215/252 |
| 4,436,212 | 3/1984 | Llera | 215/252 |
| 4,609,115 | 9/1986 | Moore et al. | 215/252 |
| 4,699,285 | 10/1987 | Perne et al. | 215/252 |

*Primary Examiner*—Donald F. Norton

[57] ABSTRACT

A tamperproof closure for a container having a threaded neck comprises a cap having an outside skirt threaded on the inside to be engaged on the neck of the container. The skirt is extended by a tamperproof band which is connected to the skirt by bridges of material that can be cut. The neck of the container is provided with a plurality of circumferentially oriented radial catches. The tamperproof band has a plurality of inside radial lugs having a profile complementary to the neck lugs, the catches and lugs being configured to permit passage of the latter over the former in the direction of screwing, and to oppose passage in the opposite direction. Below the threaded part of the container neck is provided a flange of cross section exhibiting a profile converging toward the bottom of the container. A face of each inside radial lug of the tamperproof band is beveled toward the direction of the cap top. When the flange of the neck of the container is placed axially on the neck, a traction stress is exerted on the tamperproof band in the direction of the bottom of the container.

8 Claims, 2 Drawing Sheets

TAMPERPROOF CLOSING MEANS FOR A THREADED CONTAINER NECK

FIELD OF THE INVENTION

The present invention relates to tamperproof closing means for a container with a threaded neck of the type comprising a cap comprising an outside skirt threaded on the inside and intended to be engaged on the container neck threaded on the outside, this skirt being extended by a tamperproof band which is connected to it by bridges of material that can be cut.

BACKGROUND OF THE INVENTION

In known tamperproof closing means of this type, the container neck exhibits, at its base, a plurality of circumferentially oriented radial catches. A tamperproof band exhibits a plurality of inside radial lugs with a profile complementary to that of the neck lugs, i.e., circumferentially oriented in the opposite direction, the orientations and dimensions of the catches and lugs being configured to permit passage of the latter over the former in the direction of screwing, because of the elastic deformation of the constitutive material, and to oppose this passage in the opposite direction.

A maneuver of the cap in the unscrewing direction, because of the holding of the band by the catches of the neck, causes breaking of the material bridges which connect it to the skirt of the cap.

In these known tamperproof closing means, nothing prevents the band from descending along the neck in case of prohibited or unauthorized opening of the container, which would make possible an immediate detection by a simple glance at this opening. On the other hand, nothing prevents the band from falling into a glass when, after opening the container, the container is tilted in the direction of the glass to pour all or part of the contents of the container into the glass.

These closing means further have the drawback of not effectively protecting the tamperproof band from the risks of tearing before opening of the container, especially during manueuvering of the containers by a packer.

SUMMARY OF THE INVENTION

The present invention aims at remedying these drawbacks. For this purpose, in the tamperproof closing means that it relates to and which are of the above-mentioned type, there is provided, below the threaded part of the neck of the container, i.e., near its base, a flange of cross section at least partially exhibiting a profile converging in the direction of the container bottom. The face turned in the direction of the bottom of the cap of each inside radial lug of the tamperproof band is beveled to exhibit a profile diverging in the direction of the bottom of the cap, the diameter of said flange of the container neck having a value between the inside diameter of the tamperproof band and the diameter of the circle delimited by the tops of the lugs of this band. The flange of the container neck is placed axially on this neck so that at the end of the screwing its part converging in the direction of the bottom of the container is in contact with the beveled face of the lugs of the tamperproof band, and a traction stress exerted on the tamperproof band in the direction of the container bottom results.

Thus, in case of breaking of the material bridges connecting the tamperproof band of the outside skirt of the cap, especially after an unauthorized or prohibited unscrewing of this cap, the band is projected axially in the direction of the container bottom and, thereby, far from the outside skirt of this cap, thus creating a very visible annular space between the tamperproof band and the base of the outside skirt of the cap.

According to a simple embodiment of the invention, the flange provided near the base of the container neck exhibits an approximately semicircular crosswise section against which the beveled faces of the lugs of the tamperproof band rest tangentially at the end of the screwing of the cap.

According to another interesting characteristic of the invention, there is provided, at the base of the container neck, a ring with an outside diameter at least equal to that of the tamperproof band, this ring being placed axially on the neck so that at the end of the screwing of the cap, between it and the free edge of the tamperproof band, there is an axial clearance equal to that which it preferably created between the freed edge of the outside skirt of the cap and the tamperproof band, after breaking of the material bridges connecting this band to the outside skirt of the cap.

This ring aims at assuring an effective protection of the tamperproof band during handling of the container during manueuvers of the latter by an element grasping its neck, as happens in a packer.

According to another characteristic of the invention, the regular angular distribution of the catches of the container neck and that of the lugs of the tamperproof band of the cap are different and are determined so that the lugs of the band do not all rise simultaneously on the catches, which would risk causing bursting of the band.

DESCRIPTION OF THE DRAWINGS

In any case, the invention will be better understood with the help of the following description, with reference to the accompanying diagrammatic drawing representing, by way of nonlimiting example, an embodiment of these closing means.

DETAILED DESCRIPTION OF THE INVENTION

Figure 1:
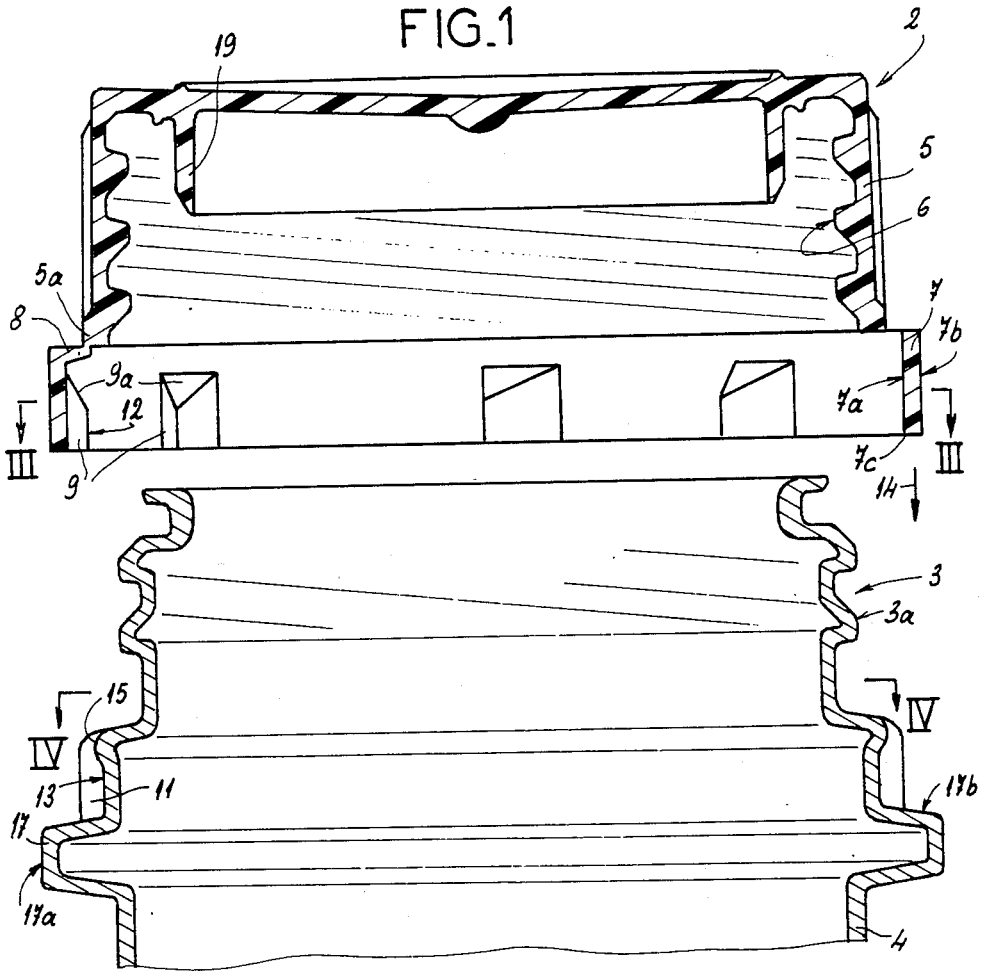
FIG. 1 is an exploded view with axial section showing the cap before it is screwed onto the container neck.

As the drawing shows, the tamperproof closing means of the invention are of the type comprising a cap 2 that can be screwed onto threaded neck 3 of a container 4, of which only the upper part of neck 3 is shown in the drawing.

Cap 2 is of the type comprising an outside cylindrical skirt 5 exhibiting an inside threading 6 and a tamperproof band 7 connected to the free edge 5*a* of skirt 5 by material bridges 8 that are easily cut.

Figure 3:
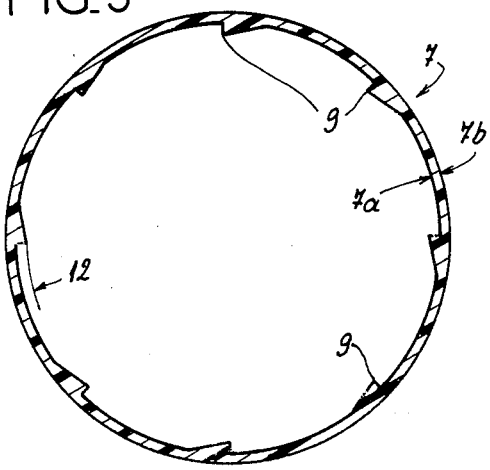
FIG. 3 is a view in a diametral section along III—III of FIG. 1.
Figure 4:
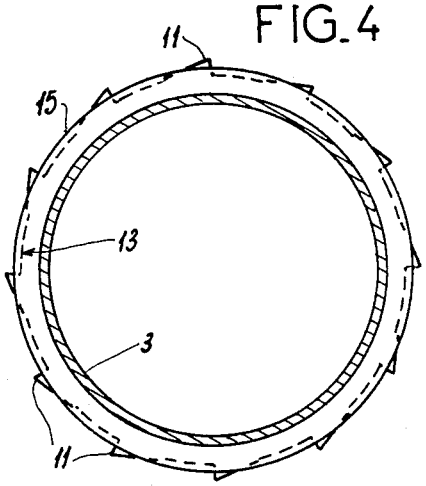
FIG. 4 is a view in diametral section along IV—IV of FIG. 1.

Tamperproof band 7 connected to cap 2 is of the known type, exhibiting, on its inside cylindrical face, lugs 9 projecting radially on the inside of band 7 and intended to work with catches 11 made near the base of neck 3 of container 4, below its outside threading 3*a*. Catches 11 are oriented circumferentially like lugs 9 of band 7 which exhibit a profile complementary to that of catches 11. The orientations of catches 11 and lugs 9 are determined to permit passage of the latter over the former in the direction of screwing while opposing this passage in the opposite direction. FIGS. 3 and 4 show the opposite circumferential orientations of lugs 9 and catches 11.

Of course, the inside diameter 12 of the circle delimited by the tops of lugs 9 of band 7 corresponds approximately to the diameter 13 of the part of neck 3 of container 4 located in the intervals between catches 11.

Figure 2:
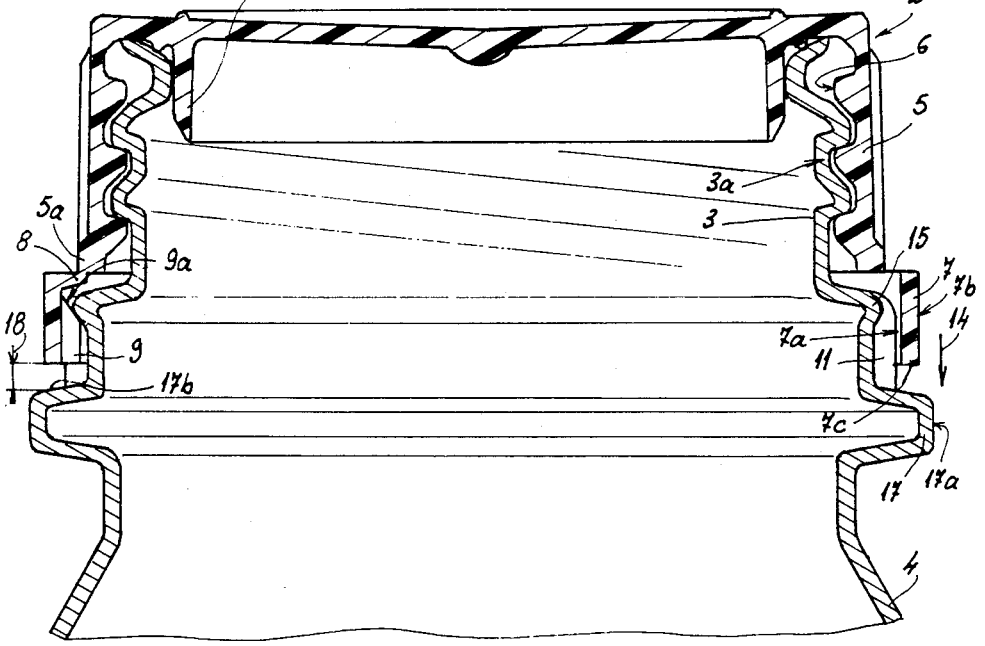
FIG. 2 is an axial view showing the cap screwed on the container neck.
Figure 5:
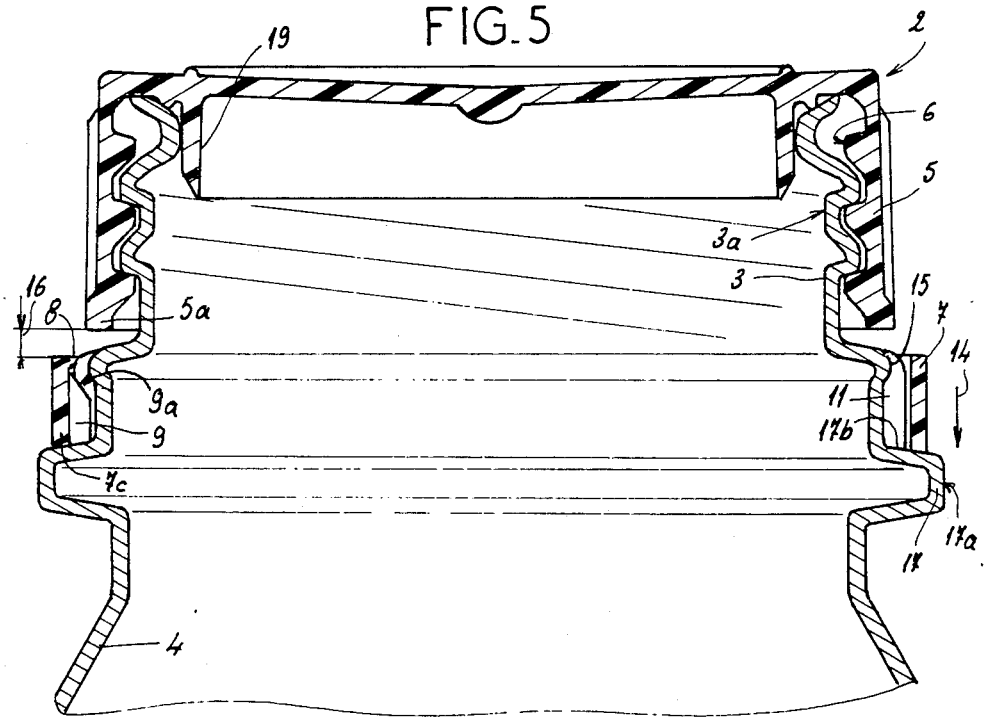
FIG. 5 is a view in axial section similar to FIG. 3, after breaking of the material bridges connecting the tamperproof band to the outside skirt of the cap.

The object of the closing means according to the invention is to cause an axial displacement of tamperproof band 7 in the direction of the bottom of container 4, i.e., in the direction of arrow 14 of FIGS. 1, 2 and 5, in case of breaking of material bridges 8 connecting band 7 to free edge 5*a* of skirt 5 of cap 2.

For this purpose, the neck 3 is provided with, in its part corresponding to the upper face of catches 11, a flange or shoulder 15, i.e., an outwardly projecting bead exhibiting at least, in its lower part, a convergence oriented in the direction of the bottom of container 4. In the example illustrated in the drawing, the cross section of flange 15 is approximately semicircular. The maximum outside diameter of flange 15 is obviously between inside diameter 7*a* of band 7 and diameter 13 of the part of neck 3 between catches 11 and corresponding to diameter 12 of the circle delimited by the tops of lugs 9 of band 7 of cap 2.

Moreover, as FIGS. 1 and 2 show more particularly, face 9*a* turned in the direction of the bottom of cap 2 of each inside radial catch 9 of tamperproof band 7 is beveled to exhibit a profile divergent in the direction of the bottom of cap 2.

Finally, flange 15 is located axially on neck 3 so that at the end of screwing of cap 2, beveled faces 9*a* of lugs 9 of band 7 rest tangentially against the part converging downward of flange 15 of neck 3, as clearly shown in FIG. 2. Further, the axial position of flange 15 is determined so that at the end of screwing of cap 2, as illustrated in FIG. 2, flange 15 exerts on lugs 9 a traction stress oriented in the direction of the bottom of container 4, i.e., oriented in the direction of arrow 14.

It is easily understood that as a result of this stress, from the time of the breaking of material bridges 8, band 7 is axially displaced in the direction of arrow 14 to create between it and freed edge 5*a* of outside skirt 5 of cap 2 an annular space 16 that can easily be seen and making it possible to detect the breaking of material bridges 8 at a glance. This arrangement therefore facilitates the immediate detection of a possible forbidden unscrewing of cap 2.

Further the presence of flange 15, since its outside diameter is greater than inside diameter 12 of the circle delimited by the tops of lugs 9 of band 7, has the effect of assuring the holding of this latter on neck 3 of container 4, when the latter is tilted to allow pouring of its content into a glass.

According to another characteristic of the invention, neck 3 of container 4 exhibits, below catches 11, a ring 17 of an outside diameter 17*a* least equal to, and preferably slightly greater than, the outside diameter 7*b* of tamperproof band 7, and whose upper face 17*b* is axially positioned on neck 3 so that at the end of screwing of cap 2, between it and free edge 7*c* of band 7, there is an axial clearance 18 equal to desired annular space 16, after breaking of material bridges 8 connecting band 7 to outside cylindrical skirt 5 of cap 2. The presence of this ring 17 has the advantage of protecting band 7 from any untimely tearing during handling of containers 4 before they are marketed and, particularly, during handling performed in the packers.

Finally, the angular distribution of lugs 9 of band 7 of cap 2 is advantageously different from that of catches 11 of neck 3 of container 4 to keep all lugs 9 from rising simultaneously on catches 11, which would run the risk of causing bursting of band 7.

In the example illustrated by FIGS. 3 and 4, catches 11 have angular distances of 30°, while lugs 9 have an angular distance 45°.

In the example illustrated in the drawing, cap 2 is of the type comprising an inside skirt 19 whose outside diameter corresponds to the inside diameter of neck 3 of container 4, but it is evident that the arrangement of the invention can be applied in the same way to any other type of threaded cap for the threaded container neck.

This invention is particularly, but not exclusively, suitable for containers of blown plastic such as PVC whose cap is itself is of molded or injected plastic such as polyethylene.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology employed herein is for the purpose of description and not of limitation.

What is claimed is:

1. Tamperproof closing means for a container with a neck partially threaded on the outside, said closing means comprising:

a cap having a top wall and an outside skirt having an inside and an outside, the inside of said skirt;

the neck of said container having lugs thereon comprising a plurality of circumferentially oriented radial catches; said tamperproof band having a plurality of inside radial lugs with a profile complementary to lugs of the neck of said bottle;

the orientations and dimensions of said catches and lugs being configured to permit passage of the lugs over the catches in the direction of screwing and to oppose this passage in the opposite direction;

a shoulder below the threaded part of the neck of the container, said shoulder at least partially exhibiting a profile converging in the direction of the bottom of the container;

each radial lug of the tamperproof band having a face beveled in a direction toward said top wall to exhibit a profile diverging in the direction of said top wall of the cap;

the diameter of the shoulder of the neck of the container having a value between the inside diameter of the tamperproof band and the diameter of a circle delimited by the radially innermost portions of the lugs of the band;

the shoulder being located on the neck of the container.

2. The closing means of claim 1 wherein the shoulder provided near the base of the neck of the container exhibits an approximately semicircular crosswise section.

3. The closing means of claim 2 wherein a ring is provided at the base of the neck of the container;

said ring having an outside diameter at least equal to that of the tamperproof band;

said ring being placed axially on the neck so that, at the end of screwing of the cap, between the ring and a free edge of the tamperproof band is an axial clearance equal to that which it is desired to create between a freed edge of the outside skirt of the cap and the tamperproof band, after breaking of the material bridges connecting the band to the outside skirt of the cap.

4. The closing means of claim 3 wherein the regular angular distribution of catches of the neck of the container and of lugs of the tamperproof band of the cap are different from one another.

5. The closing means of claim 2 wherein the regular angular distribution of catches of the neck of the container and of lugs of the tamperproof band of the cap are different from one another.

6. The closing means of claim 1 wherein a ring is provided at the base of the neck of the container;

said ring having an outside diameter at least equal to that of the tamperproof band;

said ring being placed axially on the neck so that, at the end of screwing of the cap, between the ring and a free edge of the tamperproof band is an axial clearance equal to that which it is desired to create between a freed edge of the outside skirt of the cap and the tamperproof band, after breaking of the material bridges connecting the band to the outside skirt of the cap.

7. The closing means of claim 6 wherein the regular angular distribution of catches of the neck of the container and of lugs of the tamperproof band of the cap are different from one another.

8. The closing means of claim 1 wherein the regular angular distribution of catches of the neck of the container and of lugs of the tamperproof band of the cap are different from one another.

* * * * *

UNITED STATES PATENT AND TRADEMARK OFFICE

CERTIFICATE OF CORRECTION

PATENT NO. : 4,771,904

DATED : September 20, 1988

INVENTOR(S) : Perne et al

It is certified that error appears in the above-identified patent and that said Letters Patent is hereby corrected as shown below:

On the title page:

After [76] insert:

--[73] Assignee: Astra Plastique (A Societe Anonyme - French)
Saint-Georges-De-Reneins, Rhone, Franch--

Signed and Sealed this

Third Day of March, 1992

*Attest:*

HARRY F. MANBECK, JR.

*Attesting Officer*

*Commissioner of Patents and Trademarks*